US009969201B2

(12) United States Patent
Reindl

(10) Patent No.: US 9,969,201 B2
(45) Date of Patent: May 15, 2018

(54) PAGE CONSTRUCTION FOR IMPROVED MANIPULATION AND BOOK INCORPORATING THE SAME

(71) Applicant: Kinch Robert Reindl, Denver, CO (US)

(72) Inventor: Kinch Robert Reindl, Denver, CO (US)

( * ) Notice: Subject to any disclaimer, the term of this patent is extended or adjusted under 35 U.S.C. 154(b) by 289 days.

(21) Appl. No.: 14/621,886

(22) Filed: Feb. 13, 2015

(65) Prior Publication Data

US 2016/0009117 A1 Jan. 14, 2016

Related U.S. Application Data

(63) Continuation of application No. 12/861,585, filed on Aug. 23, 2010, now Pat. No. 8,955,884.

(51) Int. Cl.
*B42D 1/00* (2006.01)
*B42F 21/12* (2006.01)

(52) U.S. Cl.
CPC ..... *B42D 1/00* (2013.01); *B42D 1/003* (2013.01); *B42F 21/12* (2013.01)

(58) Field of Classification Search
CPC ..... B42D 1/003
USPC ..... 281/38; 402/79, 32; 113/38; D19/1
See application file for complete search history.

(56) References Cited

U.S. PATENT DOCUMENTS

D11,511 S 11/1879 Hake
283,383 A 8/1883 Heebeet et al.
306,318 A 10/1884 Alfoed et al.
511,339 A 12/1893 Livesey
648,476 A 5/1900 Wiley et al.
1,011,651 A 12/1911 Stavens
1,311,733 A 7/1919 William et al.
1,404,541 A 1/1922 Parsons
4,447,481 A 5/1984 Holmberg et al.
4,877,269 A * 10/1989 Callaghan ..... B42D 1/00 281/38
5,096,204 A 3/1992 Lippman
5,328,206 A 7/1994 Scott et al.
5,401,058 A 3/1995 Holmberg
5,738,212 A * 4/1998 Pollard ..... A61F 15/001 206/210
5,827,591 A * 10/1998 Blok ..... B42D 5/003 428/43
5,967,555 A * 10/1999 Samelian ..... B42F 3/00 402/500

(Continued)

FOREIGN PATENT DOCUMENTS

FR 2865158 A1 * 7/2005 ..... B42D 1/003

*Primary Examiner* — Kyle Grabowski
(74) *Attorney, Agent, or Firm* — Perkins Coie LLP

(57) ABSTRACT

A book having a page construction for improved page manipulation. The book includes a plurality of pages bound together at an edge margin, wherein each page includes a bound edge and a plurality of free edges. At least one of the free edges of at least one of the pages includes an edge relief. The pages may comprise cardboard or other stiff material having a thickness. The free edges include opposed top and bottom edges and a side edge. The edge relief may extend along the entire side edge or only a portion thereof. The edge relief may be in the form of, for example, a chamfer, a bevel, a radius, a notch, a step, or the like.

16 Claims, 6 Drawing Sheets

(56) References Cited

U.S. PATENT DOCUMENTS

| | | | | |
|---|---|---|---|---|
| 6,071,584 | A * | 6/2000 | Ritter | B42D 5/003 283/81 |
| 6,777,055 | B2 * | 8/2004 | Janssen | B32B 7/06 428/41.8 |
| 7,037,564 | B1 | 5/2006 | Abron | |
| 7,632,418 | B2 | 12/2009 | Killey | |
| 2001/0033077 | A1 | 10/2001 | Chen | |
| 2007/0024046 | A1 * | 2/2007 | Loo | A63H 33/38 281/38 |
| 2009/0102178 | A1 * | 4/2009 | Thompson | B42D 3/02 281/38 |
| 2009/0284002 | A1 | 11/2009 | Miranti | |
| 2010/0207375 | A1 | 8/2010 | Gruber | |
| 2011/0298202 | A1 | 12/2011 | Hocking | |
| 2011/0316266 | A1 | 12/2011 | Miranti | |
| 2012/0153606 | A1 * | 6/2012 | Legrand | B42D 1/007 281/38 |

* cited by examiner

PAGE CONSTRUCTION FOR IMPROVED MANIPULATION AND BOOK INCORPORATING THE SAME

CROSS-REFERENCE TO RELATED APPLICATION

The present application claims priority to and benefit from U.S. patent application Ser. No. 12/861,585 titled "Page Construction For Improved Manipulation And Book Incorporating The Same" filed on Aug. 23, 2010, the entire content of which is herein expressly incorporated by reference.

FIELD OF THE DISCLOSURE

The present disclosure relates to books and book pages. More particularly it relates to stiff paged board books having a unique page configuration that facilitates page turning by young children and those with impaired dexterity.

BACKGROUND OF THE INVENTION

Children and other people with dexterity challenges may have difficulty in selecting individual pages of books that use typical paper pages. Many children's books are comprised of thick fiber or card board pages which are more easily manipulated than thin paper pages. These thick pages are also more resistant to damage, such as tearing, than their thin paged counterparts. However, young children and dexterity challenged individuals with reduced ability to distinguish between individual pages by touch still find it difficult to select individual pages in the book. The problem is exacerbated in board books because the stiff pages contribute to a vacuum forming between pages which has a tendency to cause them to stick together. There have been various attempts to address the problems with board books. However, while each of these attempts may be an improvement over a basic board book they each still have disadvantages as described below.

For example, U.S. Pat. No. 5,328,206 describes a stiff-paged board book which uses spacing structures between the pages to form a space between the pages so individual pages may be turned by young children. The spacing structure includes attaching blocks to the outer portion of each page to keep the pages from completely closing. They also note that magnets can be embedded in each page to help eliminate the issue of pages sticking together. These blocks or protrusions may provide space between the pages but are unorthodox since they involve attaching something to each page. One disadvantage of the book described in this patent is the possible easy removal of the blocks. Children are prone to pull items off of pages which would eliminate the page gap, not to mention that the small parts may pose a choking hazard. Another possible issue caused by the blocks and protrusions includes the warping of the pages of the book when the book is compressed in shipping or when stacked under other books (or any other time the book has weight placed upon it). The blocks and protrusions could create indentions in the other pages when compressed which would lessen the gap between the pages. Manufacturing cost would be increased by having to affix the blocks, create protrusions, or embed magnets. Packaging costs could be increased to protect the books from being compressed. And shipping costs may be increased by the extra size of each book since each book is thicker because of the space between the pages. Also the gaps at the top and bottom of each page are not the same uniform size (the gap gets larger from the spine to the outside of the book).

U.S. Pat. No. 511,339 describes a book with pages that have a portion of each page removed on the edge of the book opposite the spine. Each removed section is of a similar shape but varying size. Each page has either an increasing or decreasing amount of the page removed than the previous page which creates layers. These layers do not create gaps between the individual pages thus require more dexterity and knowledge to use. These layers are not uniform around the entire page. To manufacture these pages requires extra work to make each page a different size and to ensure that the pages are properly ordered by shape. An increasing portion of each page is eliminated which reduces the amount of usable space on each subsequent page.

U.S. Pat. No. 648,476 describes an index book to be used to index loose papers. Each page has a round stub at the edge. Each of these stubs is in a different location than the preceding and following page to create a tab for identification. As previously cited in U.S. Pat. No. 511,339 these tabs do not create a gap between the pages and they are limited to one small tab on each page. Sight and depth perception are necessary to determine which tab is connected to the next page.

Other Patents dealing with page construction include U.S. Pat. Nos. 283,383; 306,318; 1,311,733; and 1,404,541. These patents attempt to accomplish the same goals as U.S. Pat. Nos. 511,339 and 648,476 described above, which is to identify pages or sections of books. They attempt this by removing parts of each subsequent page or by cutting out segmental recesses in different sections. Each exposed page or segmental recesses can be labeled to identify the section. These are implemented to visually index each section of a book. They do not create gaps between the pages for easy selection of each page by those with limited dexterity. Moreover, they suffer from similar manufacturing complexities as described above.

While the above described books may be improvements over the traditional stiff paged board-book, each of these books has disadvantages as noted above that are heretofore unresolved. Thus, there is still a need for an easily implemented page construction that provides a page that a child or other dexterity challenged individual can more easily manipulate.

SUMMARY OF THE INVENTION

Described herein is a book having a page construction designed for improved page manipulation. In an exemplary embodiment, the book comprises a plurality of pages bound together at an edge margin, wherein each page includes a bound edge and a plurality of free edges. At least one of the free edges of at least one of the pages includes an edge relief. The pages may comprise cardboard or other stiff material having a thickness. The free edges include opposed top and bottom edges and a side edge. In an exemplary embodiment each of the top, bottom, and side edges includes an edge relief. In another embodiment only the side edge includes an edge relief. The edge relief may extend along the entire side edge or only a portion thereof. The edge relief may be in the form of, for example, a chamfer, a bevel, a radius, a notch, a step, or the like. In an exemplary embodiment the edge relief extends at least one half the way through the thickness of the page.

In an exemplary embodiment each page has first and second sides, each of which includes an associated edge relief. In one embodiment each edge relief extends approximately one third the way through the thickness.

In an exemplary embodiment each page may include a plurality of laminated layers. At least one of the laminated layers includes at least one edge portion that is incongruent with at least one of the other layers, thereby forming the edge relief.

A board book is also contemplated herein. In an exemplary embodiment the board book comprises a front cover and a plurality of cardboard pages bound together at an edge margin. Each page includes a bound edge, opposed top and bottom edges, a side edge, and an edge relief extending along at least a portion of the side edge. The front cover may include an edge relief similar to that described above with respect to the pages. The book may also include a back cover.

The foregoing and other features, utilities, and advantages of the page construction designed for improved page manipulation will be apparent from the following more particular description of the embodiments as illustrated in the accompanying drawings.

BRIEF DESCRIPTION OF THE DRAWINGS

The accompanying drawings, which are incorporated in and constitute a part of this specification, illustrate embodiments of a page construction designed for improved page manipulation and together with the description, serve to explain the principles and operation thereof. Like items in the drawings are generally referred to using the same numerical reference.

DETAILED DESCRIPTION

Figure 1:
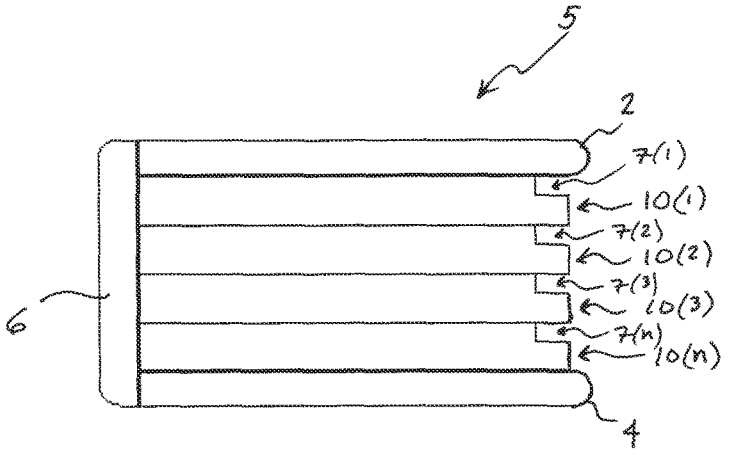
FIG. 1 is a side view in elevation of a board book that includes a page construction for improved manipulation according to a first exemplary embodiment.
Figure 2:
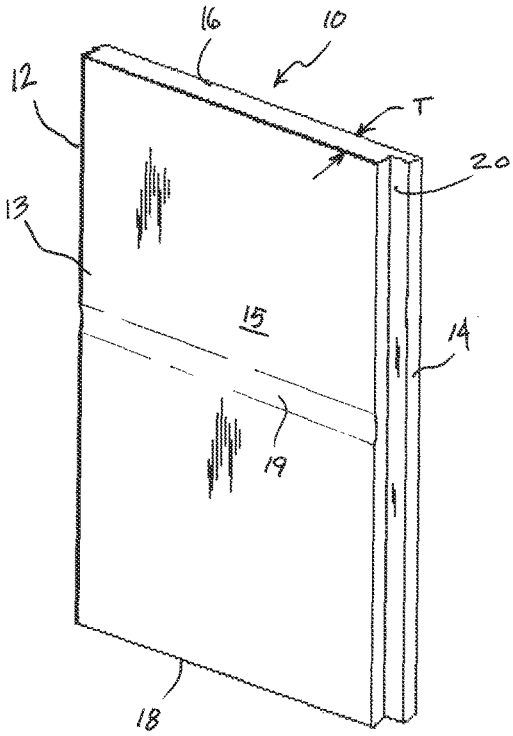
FIG. 2 is a perspective view of the page construction according to the first exemplary embodiment shown in FIG. 1.

Described herein is a page construction for improved page manipulation. The page construction provides an edge relief that is easily grasped by children or other individuals with limited dexterity. As shown in FIG. 1, book 5 incorporates a page construction for improved manipulation. Book 5 includes a front cover 2, a back cover 4 and a binding 6. Book 5 also includes a plurality of pages 10(1)-10(*n*) according to a first exemplary embodiment. Each page 10(1)-10(*n*) includes an edge relief that creates a gap 7(1)-7(*n*) between the edges of adjacent pages. Thus, each page is more readily discernable to a reader of the book. Also, the reader may push their finger into a gap 7(*n*) in order to force adjacent pages apart, thereby breaking the vacuum that sometimes forms between the pages. In order to further assist a reader in breaking the vacuum, the pages may include an optional channel 19, as shown in FIG. 2. In this case, channel 19 is pressed into the page to form an indentation as shown. Alternatively, the channel may be milled, routed, or otherwise cut into the page.

Figure 3:
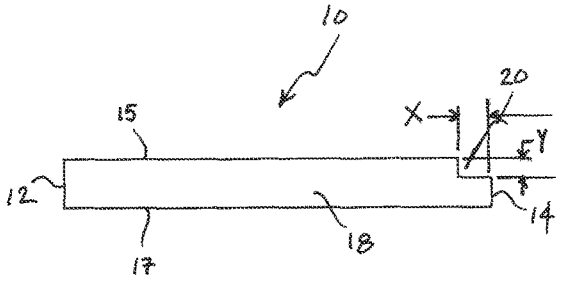
FIG. 3 is an end view of the page construction shown in FIGS. 1 and 2.

With continued reference to FIG. 2, it can be appreciated that each page 10 includes a bound edge 12 and a plurality of free edges, which include side edge 14, top edge 16, and bottom edge 18. As is known in the art, the pages may be bound along an edge margin 13 that is adjacent the bound edge 12 by gluing, ring binding, or other known binding methods. Each page also includes a front (first) side 15 and a back (second) side 17 separated by a thickness T. With further reference to FIG. 3, side edge 14 includes an edge relief 20. It can be appreciated that edge relief 20 is, in this case, in the form of a notch or step that extends inward from side edge 14 a distance X. Edge relief 20 is, in this case, adjacent to front side 15 and extends through thickness T a distance Y. In this case, distance Y is approximately half way through thickness T. Preferably, however, distance Y may range from less than a third to more than half the thickness T, depending on the material that the pages are comprised of. Moreover, it should be understood that while in this embodiment edge relief 20 is adjacent to front side 15, the edge relief may be adjacent to back side 17.

Different materials may be used to form the pages of the board book. Any suitable book board, or fiber board, and/or cardboard, as is known in the art, may be used. For example, white board or gray board may be used. White board, or white art board, comprises pressed cardboard, with a white laminated surface, and white fibers all the way through. Gray board is a similar material, but contains gray fibers in the middle. Board is often specified by thickness and weight. The weight is specified by grams/square meter (gsm), and the thickness is specified in points (pt). Typical weights are in the 300 to 400 gsm range, with an 18 to 25 pt thickness. The material in white board may also be referred to as SBS, which stands for solid bleached sulfate. The pages may also be comprised of plastic or rubber, for example. While book board may be relatively stiff, the pages may be comprised of flexible materials as well.

Figure 4:
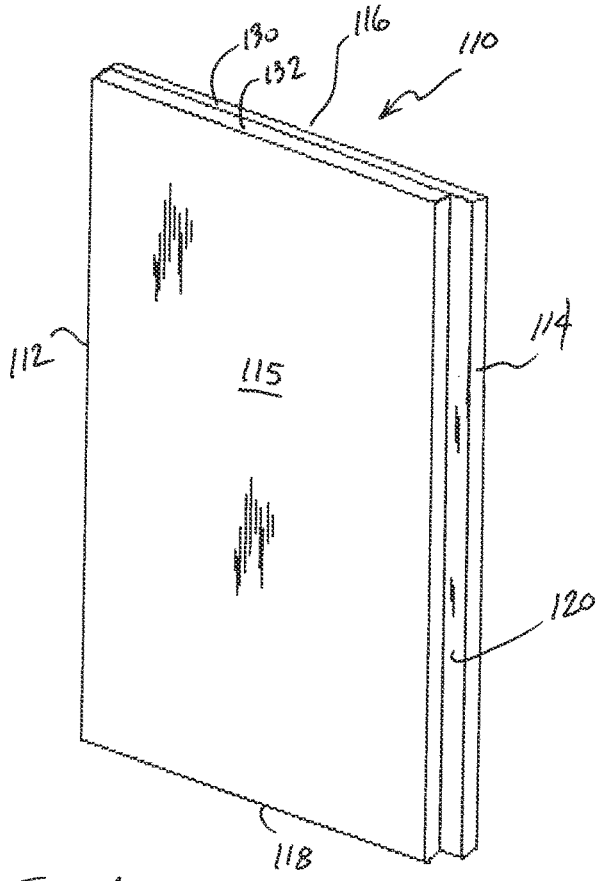
FIG. 4 is a perspective view of a layered page construction according to a second exemplary embodiment.
Figure 5:
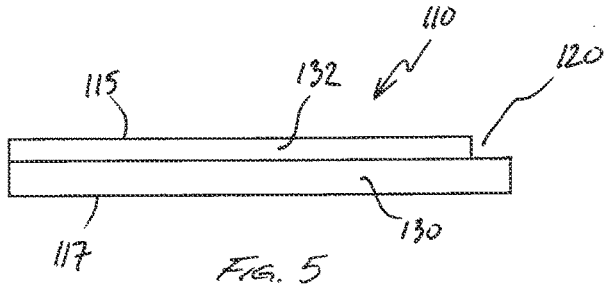
FIG. 5 is an end view of the page construction shown in FIG. 4.
Figure 6:
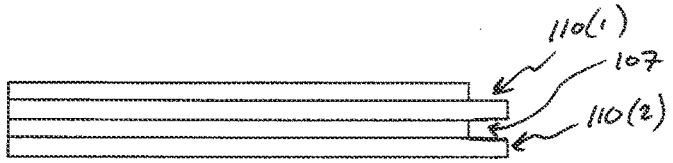
FIG. 6 is an end view showing a pair of pages as shown in FIGS. 4 and 5 stacked together.
Figure 7:
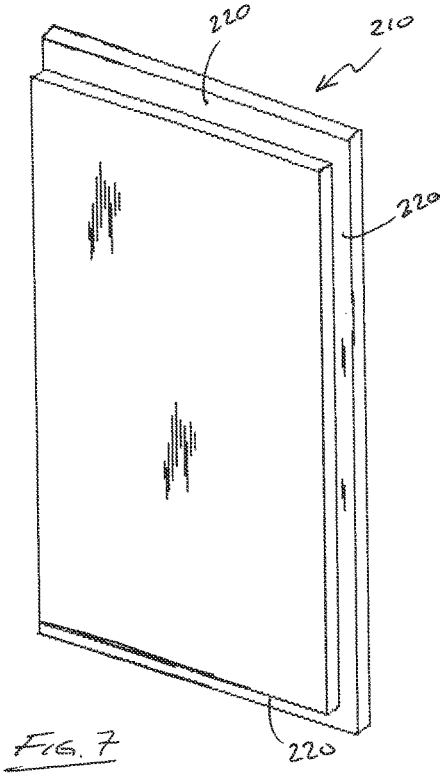
FIG. 7 is a perspective view of a layered page construction according to a third exemplary embodiment with the edge relief extending around the free edges.
Figure 8:
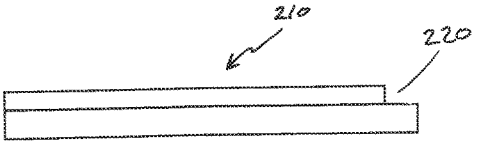
FIG. 8 is an end view of the page construction shown in FIG. 7.

The edge relief 20 may be milled, routed, cut, shaved, or pressed into a fiber board page. Alternatively, the edge relief may be formed along the edge of a page by stacking or laminating layers of board having different shapes and/or dimensions as shown in FIG. 4, for example. FIGS. 4 and 5 illustrate a page 110 according to a second exemplary embodiment. In this embodiment page 110 is comprised of a plurality of layers 130 and 132 which are adhered or laminated to each other. It can be appreciated that layer 132 has a congruent bound edge 112, top edge 116 and bottom edge 118. However layer 132 has an incongruent edge portion on the side edge 114 of the page, which forms the edge relief 120, in the form of a notch or step. FIG. 6 illustrates a pair of pages 110(1) and 110(2) stacked together to form gap 107 in a similar fashion to that in the first embodiment described above with respect to FIGS. 1-3. The edge relief may extend along an entire edge, along multiple edges, along a portion of an edge, and/or along portions of multiple edges. FIGS. 7 and 8 illustrate a page according to a third exemplary embodiment with an edge relief 220 extending along the top, bottom, and side edges.

Figure 9:
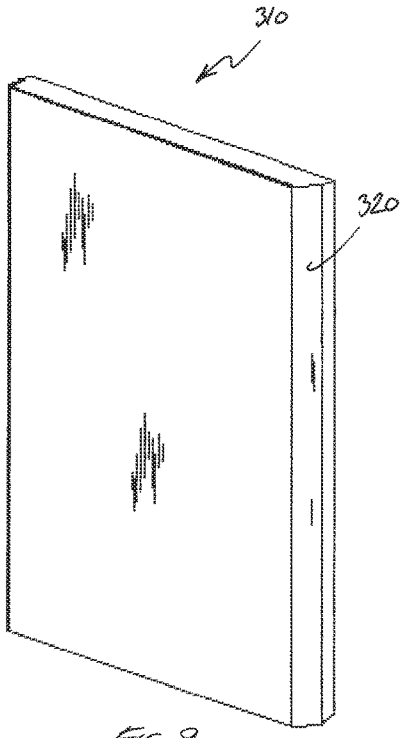
FIG. 9 is a perspective view of a page construction according to a fourth exemplary embodiment.
Figure 10:
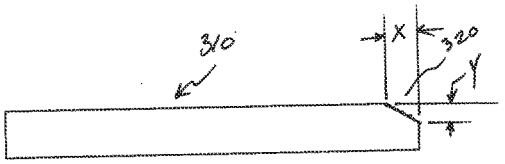
FIG. 10 is an end view of the page construction shown in FIG. 9.

The edge relief may be in the form of a notched or stepped edge, a radius, a bevel, or a chamfer as shown in, for example, FIGS. 9 and 10. Page 310 includes an edge relief 320 in the form of a chamfer or beveled edge. As shown in FIG. 10 chamfer 320 extends through the thickness of the page a distance Y and along the side a distance X, similar to the notch edge relief 20 shown in FIGS. 2 and 3, for example. It can be appreciated from the figures that when a plurality of pages 310 are stacked, chamfer 320 will create gaps between adjacent pages, thereby making the pages more readily discernable to a user.

Figure 11:
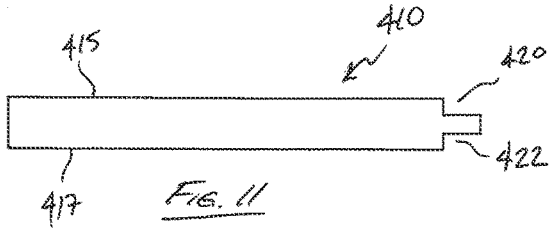
FIG. 11 is an end view of a page construction according to a fifth exemplary embodiment.
Figure 12:
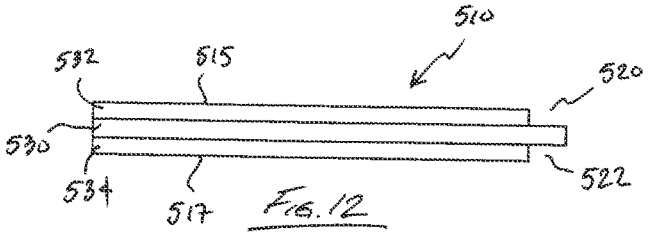
FIG. 12 is an end view of a page construction according to a sixth exemplary embodiment.

While the edge relief has been described in the previous embodiments as being on one side or the other of the page, both sides of the page can include an edge relief. FIG. 11, for example, illustrates a page 410, according to a fifth exemplary embodiment, that includes two edge reliefs 420 and 422. Edge relief 420 in the form of a notch is adjacent to front side 415 and edge relief 422 is adjacent back side 417. Here again, edge reliefs 420 and 422 may be formed by cutting, milling, routing, or the like. Alternatively, as shown in FIG. 12, a page 510 may be comprised of several layers laminated together. Page 510 includes central layer 530 and front layer 532 and back layer 534. Layers 532 and 534 each include an edge portion that is incongruent with at least one edge (side edge) of the central layer 530, thereby forming edge reliefs 520 and 522.

Figure 13A:
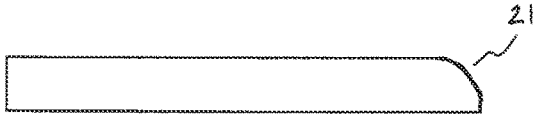
FIGS. 13A-13D are end views illustrating various alternative constructions for the edge relief.
Figure 13B:
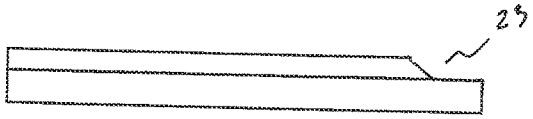
Figure 13C:
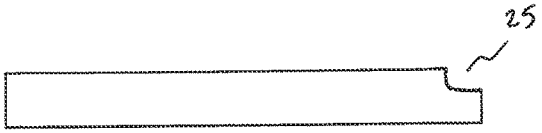
Figure 13D:
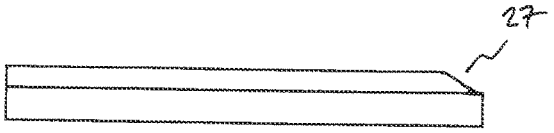

FIGS. 13A-13D illustrate various examples of alternative edge relief configurations. FIG. 13A illustrates a convex radius edge relief 21. FIG. 13B illustrates a layered page comprising a layer having a chamfer set back from the edge of the adjacent layer, to form edge relief 23. FIG. 13C illustrates a concave radius edge relief 25. FIG. 13D illustrates a layered page comprising a layer having a chamfer that aligns with the edge of the adjacent layer, to form edge relief 27.

Figure 14:
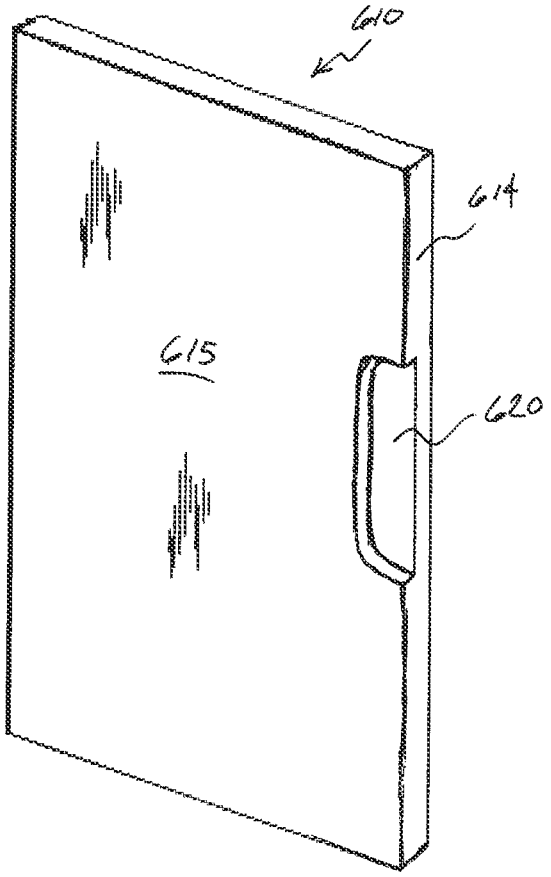
FIG. 14 is a perspective view of a page construction illustrating an edge relief that extends along only a portion of the side edge.
Figure 15:
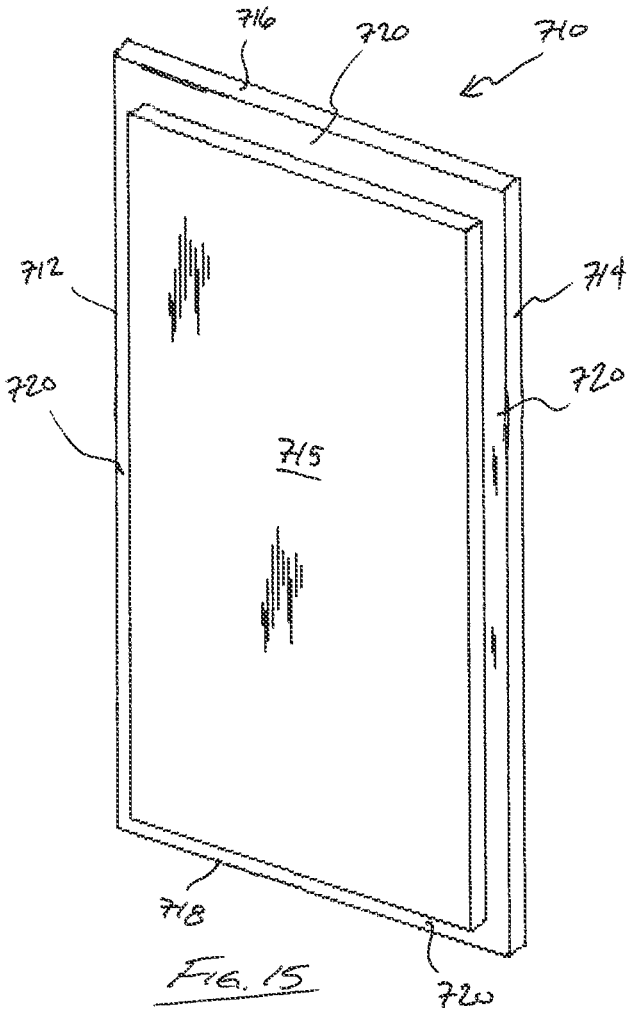
FIG. 15 is a perspective view of a page construction illustrating an edge relief that extends along the bound edge as well as the free edges.
Figure 16:
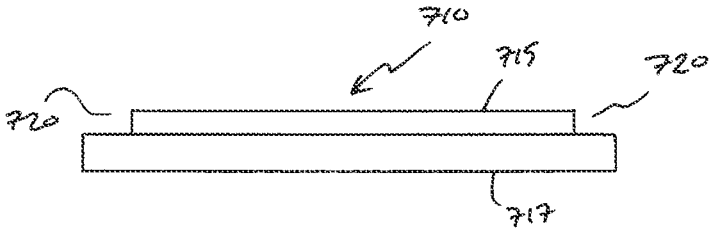
FIG. 16 is an end view of the page construction shown in FIG. 15.

FIG. 14 shows a page construction 610 according to a seventh exemplary embodiment, illustrating an example of an edge relief 620 that extends along only a portion of the side edge 614. It can be appreciated that edge relief 620 may be milled or otherwise formed into a single layer of page material. Alternatively, the page may comprise multiple layers with one layer having a cut out, or incongruent portion, to define the edge relief. FIGS. 15 and 16 illustrate an embodiment of a page construction 710 including an edge relief 720 that extends along edges 712, 714, 716, and 718 an is adjacent to the front side 715 of page 710.

Accordingly, the page construction and book incorporating the same has been described with some degree of particularity directed to the exemplary embodiments. It should be appreciated, though, that the present invention is defined by the following claims construed in light of the prior art so that modifications or changes may be made to the exemplary embodiments without departing from the inventive concepts contained herein.

What is claimed is:

1. A book comprising:

a plurality of pages bound together at an edge margin, wherein each page has a page thickness and comprises a plurality of laminated layers of the same material, each having a layer thickness of at least 18 points, and each page including:

a bound edge; and a plurality of free edges;

wherein at least one of said free edges of at least one of said pages includes an edge relief extending at least one third the way through said page thickness.

2. The book according to claim 1, wherein said pages comprise cardboard.

3. The book according to claim 1, wherein said free edges include opposed top and bottom edges and a side edge.

4. The book according to claim 3, wherein each of said top, bottom, and side edges include an edge relief.

5. The book according to claim 3, wherein said side edge includes an edge relief.

6. The book according to claim 5, wherein said edge relief extends along said side edge.

7. The book according to claim 5, wherein each said page has first and second sides, and wherein each said first and second side has an associated edge relief.

8. The book according to claim 1, wherein at least one of said laminated layers includes at least one edge portion that is incongruent with at least one of the other layers, thereby forming said edge relief.

9. A board book comprising:

a front cover;

a back cover;

a plurality of pages bound together at an edge margin, wherein each page has a page thickness and includes a bound edge, opposed top and bottom edges, and a side edge, wherein each page comprises a plurality of laminated layers each of the same material and having a layer thickness of at least 18 points; and an edge relief extending along at least a portion of said side edge, wherein said edge relief extends at least one third the way through said page thickness.

10. The board book according to claim 9, wherein each said page has first and second sides, and wherein each said first and second side has an associated edge relief, wherein each said edge relief extends approximately one third the way through said page thickness.

11. The board book according to claim 9, wherein said edge relief extends at least one half the way through said page thickness.

12. A book comprising:

a plurality of pages bound together, wherein each page has a page thickness and includes:

a bound edge, opposed top and bottom edges, and a side edge opposite the bound edge, wherein each page comprises a plurality of laminated layers, each having a layer thickness of at least 18 points; and wherein at least one of said top, bottom, and side edges of at least one of said pages includes an edge relief extending at least one quarter the way through said page thickness.

13. The book according to claim 12, wherein said pages comprise cardboard.

14. The book according to claim 12, wherein said side edge includes an edge relief.

15. The book according to claim 14, wherein said edge relief extends along said side edge.

16. The book according to claim 12, wherein each said page has first and second sides, and wherein each said first and second side has an associated edge relief.

* * * * *